US009448004B2

(12) United States Patent
Kim et al.

(10) Patent No.: US 9,448,004 B2
(45) Date of Patent: Sep. 20, 2016

(54) REFRIGERATOR HAVING DOUBLE DOORS

(71) Applicant: SAMSUNG ELECTRONICS CO., LTD., Suwon-si, Gyeonggi-do (KR)

(72) Inventors: Seong Woo Kim, Anyang-si (KR); Byoung Mok Kim, Gwangju (KR); Seung Yong Yang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/186,315

(22) Filed: Feb. 21, 2014

(65) Prior Publication Data

US 2014/0232250 A1 Aug. 21, 2014

(30) Foreign Application Priority Data

Feb. 21, 2013 (KR) ..... 10-2013-0018340

(51) Int. Cl.
*F25D 23/02* (2006.01)
*E05F 1/06* (2006.01)

(52) U.S. Cl.
CPC ..... *F25D 23/028* (2013.01); *E05F 1/063* (2013.01); *F25D 23/025* (2013.01); (Continued)

(58) Field of Classification Search
CPC .... F25D 23/02; F25D 23/025; F25D 23/028; F25D 23/04; F25D 23/14; F25D 2323/0011; A47B 91/00; A47B 91/02; A47B 91/022; A47B 91/024; A47B 91/026
USPC ..... 312/405, 326, 329, 319.2, 324; 49/73.1, 49/98, 104, 163, 168, 169, 170; 292/95, 292/96, 121, 122, 126–128, 101, 194, 195, 292/219, 220, 227, 228, 202, DIG. 15, 292/DIG. 61; 62/377; 16/309, 312
See application file for complete search history.

(56) References Cited

U.S. PATENT DOCUMENTS 3,648,327 A * 3/1972 Edeus ..... E05F 1/061 16/236
4,070,728 A * 1/1978 Herman ..... 16/243
(Continued)

FOREIGN PATENT DOCUMENTS

CN 202853238 U * 4/2013 ..... F25D 23/00
EP 1 371 923 A1 12/2003
(Continued)

OTHER PUBLICATIONS

PCT International Search Report mailed May 22, 2014 in International Application No. PCT/KR2014/001296.
(Continued)

*Primary Examiner* — Andrew Roersma
(74) *Attorney, Agent, or Firm* — Staas & Halsey LLP

(57) ABSTRACT

A refrigerator is disclosed. The disclosed refrigerator includes a body having a storage chamber, a first door pivotably provided at a front side of the body, to open or close the storage chamber, the first door having an opening, and at least one door pocket provided at the opening, a second door pivotably provided at a front side of the first door, to open or close the opening, the second door pivoting in the same direction as the first door, a first upper hinge and a first lower hinge respectively coupled to upper and lower surfaces of the body, to pivotably support the first door, and a second upper hinge and a second lower hinge respectively coupled to upper and lower surfaces of the first door, to pivotably support the second door.

13 Claims, 14 Drawing Sheets

(52) U.S. Cl.
CPC ..... *E05Y 2800/71* (2013.01); *E05Y 2900/31* (2013.01); *F25D 2323/021* (2013.01); *F25D 2323/023* (2013.01); *F25D 2323/024* (2013.01)

(56) References Cited

U.S. PATENT DOCUMENTS

| | | | | |
|---|---|---|---|---|
| 5,138,743 | A | 8/1992 | Hoffman | |
| 7,506,474 | B2 * | 3/2009 | Yoshikawa et al. | 49/257 |
| 7,685,678 | B2 * | 3/2010 | Moon et al. | 16/243 |
| 8,233,161 | B2 * | 7/2012 | Saito | 358/1.13 |
| 2003/0151339 | A1 | 8/2003 | Reed et al. | |
| 2004/0040118 | A1 | 3/2004 | Han et al. | |
| 2006/0168760 | A1 | 8/2006 | Espindola et al. | |
| 2008/0203739 | A1 | 8/2008 | Lim et al. | |
| 2011/0023527 | A1 * | 2/2011 | Kwon et al. | 62/441 |
| 2011/0023528 | A1 * | 2/2011 | Kwon et al. | 62/441 |
| 2012/0038258 | A1 * | 2/2012 | Park et al. | 312/405 |
| 2013/0026900 | A1 | 1/2013 | Oh et al. | |
| 2013/0033163 | A1 | 2/2013 | Kang | |
| 2013/0049562 | A1 * | 2/2013 | Jung et al. | 312/405 |
| 2013/0154464 | A1 * | 6/2013 | Fiori | E05D 7/0423 312/405 |
| 2013/0169138 | A1 * | 7/2013 | Im et al. | 312/404 |

FOREIGN PATENT DOCUMENTS

| | | | | |
|---|---|---|---|---|
| JP | S63142682 U | * | 9/1988 | F25D 23/02 |
| JP | 2004-301457 | | 10/2004 | |
| KR | 1999-0032434 | | 5/1999 | |
| KR | 2003-0081512 | | 10/2003 | |
| KR | 10-2008-0047148 | | 5/2008 | |
| KR | 20-2009-0004606 | | 5/2009 | |
| KR | 10-2010-0008271 | | 1/2010 | |
| KR | 10-2011-0011400 | | 2/2011 | |
| KR | 10-2012-0015246 | | 2/2012 | |
| KR | 10-2012-0040891 | | 4/2012 | |
| WO | WO 03/097974 A2 | * | 11/2003 | F25D 23/02 |
| WO | WO 2011/081279 A1 | | 7/2011 | |

OTHER PUBLICATIONS

Office Action mailed Apr. 28, 2015 for corresponding Korean Patent Application No. 10-2013-0018340.

Extended European Search Report mailed Jun. 26, 2015 for corresponding European Patent Application No. 14156178.7.

Korean Office Action dated May 11, 2016 in corresponding Korean Patent Application No. 10-2016-0015429.

* cited by examiner

REFRIGERATOR HAVING DOUBLE DOORS

CROSS-REFERENCE TO RELATED APPLICATIONS

This application claims the benefit of Korean Patent Application No. 10-2013-18340, filed on Feb. 21, 2013 in the Korean Intellectual Property Office, the disclosure of which is incorporated herein by reference.

BACKGROUND

1. Field

Embodiments of the present disclosure relate to a refrigerator which includes a first door rotatably provided to open or close a storage chamber while having an opening, at least one door pocket provided at the opening, and a second door rotatably provided to open or close the opening.

2. Description of the Related Art

A refrigerator is a home appliance including a storage chamber to store food, and a cold air supplier to supply cold air to the storage chamber in order to keep food fresh for long time.

In the storage chamber, racks for stowing food may be provided. The storage chamber is opened at a front side, to allow food to be placed or retrieved. The opened front side of the storage chamber may be opened or closed by a first door pivotally coupled to a body of the refrigerator, and a door pocket may be provided at a back surface of the first door, to store food, separately from the racks disposed in the storage chamber.

Access to such a door pocket is allowed when the first door is opened, because the door pocket is provided at the back surface of the first door. Meanwhile, there is a refrigerator in which a separate second door is provided at the first door, to allow access to the door pocket without opening the first door. Such a refrigerator, which includes the second door, achieves enhanced storage of various food articles while achieving enhanced keeping of cold air because access to the door pocket is allowed without opening the first door of the refrigerator by opening only the second door.

However, such a second door has a limited size. For this reason, when the refrigerator has a plurality door pockets vertically arranged at the back surface of the first door, access to only a portion of the door pockets is allowed.

SUMMARY

Therefore, it is an aspect of the present disclosure to provide a refrigerator including a plurality of door pockets provided at a first door, which is capable of allowing access to all of the door pockets without opening the first door by opening only a second door provided at the first door.

Additional aspects will be set forth in part in the description which follows and, in part, will be obvious from the description, or may be learned by practice of the invention.

In accordance with one aspect, a refrigerator includes a body having a storage chamber, a first door pivotably provided at a front side of the body, to open or close the storage chamber, the first door having an opening, and at least one door pocket provided at the opening, a second door pivotably provided at a front side of the first door, to open or close the opening, the second door pivoting in the same direction as the first door, a first upper hinge and a first lower hinge respectively coupled to upper and lower surfaces of the body, to pivotably support the first door, and a second upper hinge and a second lower hinge respectively coupled to upper and lower surfaces of the first door, to pivotably support the second door.

The first upper hinge, the first lower hinge, the second upper hinge, and the second lower hinge may be coupled to the upper surface of the body, the lower surface of the body, the upper surface of the first door, and the lower surface of the first door by fastening members, respectively, and may be separable through unfastening of the fastening members.

Pivotal axes of the first and second doors may not be coaxial.

The refrigerator may further include a first auto closer to pivot the first door in a closing direction to a position where the first door is completely closed, when the first door pivots a predetermined angle or more in the closing direction.

The first auto closer may include a first cam member having first cam surfaces formed to be inclined in upward and downward directions in an alternating manner along a circumferential direction of the first cam member, and a second cam member having second cam surfaces formed to be inclined such that the second cam surfaces correspond to the first cam surfaces.

The first auto closer may include a first cam member coupled to an upper surface of the first lower hinge, and a second cam member coupled to a lower surface of the second lower hinge.

The refrigerator may further include a second auto closer to pivot the second door in a closing direction to a position where the second door is completely closed, when the second door pivots a predetermined angle or more in the closing direction.

The second auto closer may include an elastic lever to accumulate an elastic force generated during closing of the second door, and then to pivot the second door in the closing direction to the position where the second door is completely closed, by the accumulated elastic force, when the second door pivots the predetermined angle or more in the closing direction.

The second auto closer may include an elastic lever coupled to a lower surface of the second door. The elastic lever may be pressed by the second lower hinge during closing of the second door, to be elastically deformed.

The first lower hinge may include a support leg contacting a floor.

In accordance with one aspect, a refrigerator includes a body having a storage chamber, a first door pivotably provided at a front side of the body, to open or close the storage chamber, the first door having an opening, and at least one door pocket provided at the opening, a second door pivotably provided at a front side of the first door, to open or close the opening, the second door pivoting in the same direction as the first door, a first upper hinge and a first lower hinge to pivotably support the first door, a second upper hinge and a second lower hinge to pivotably support the second door, a first auto closer to pivot the first door in a closing direction to a position where the first door is completely closed, when the first door pivots a predetermined angle or more in the closing direction, and a second auto closer to pivot the second door in a closing direction to a position where the second door is completely closed, when the second door pivots a predetermined angle or more in the closing direction.

The first auto closer may include a first cam member having first cam surfaces formed to be inclined in upward and downward directions in an alternating manner along a circumferential direction of the first cam member, and a second cam member having second cam surfaces formed to be inclined such that the second cam surfaces correspond to the first cam surfaces. The second auto closer may include an elastic lever to accumulate an elastic force generated during closing of the second door, and then to pivot the second door in the closing direction to the position where the second door is completely closed, by the accumulated elastic force, when the second door pivots the predetermined angle or more in the closing direction.

The first auto closer may include a first cam member coupled to an upper surface of the first lower hinge, and a second cam member coupled to a lower surface of the second lower hinge. The second auto closer may include an elastic lever coupled to a lower surface of the second door. The elastic lever may be pressed by the second lower hinge during closing of the second door, to be elastically deformed.

The first lower hinge may include a support leg contacting a floor.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Reference will now be made in detail to the preferred embodiments, examples of which are illustrated in the accompanying drawings.

Figure 1:
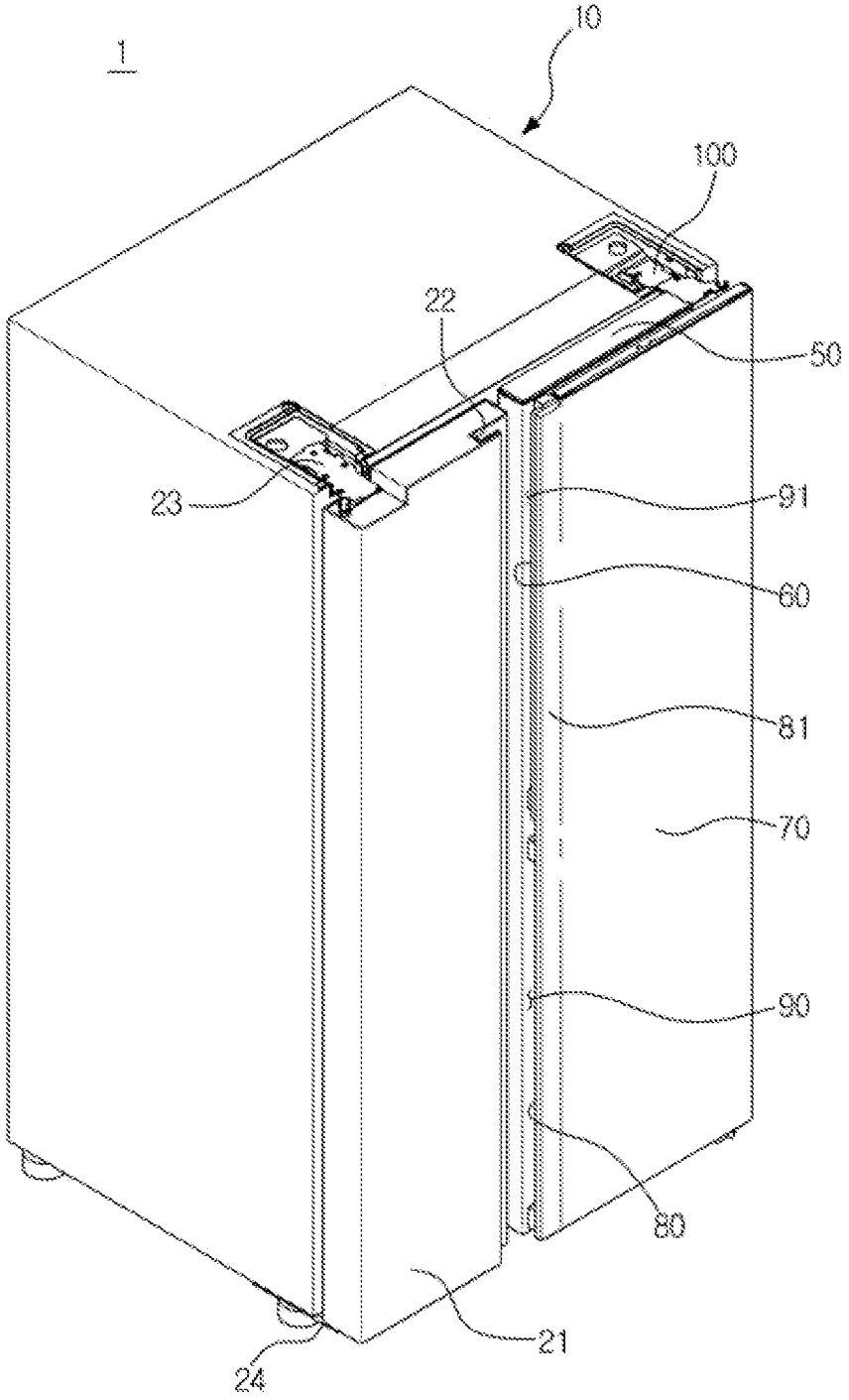
FIG. 1 is a perspective view illustrating a refrigerator according to an embodiment in a state in which first and second doors are closed.
Figure 2:
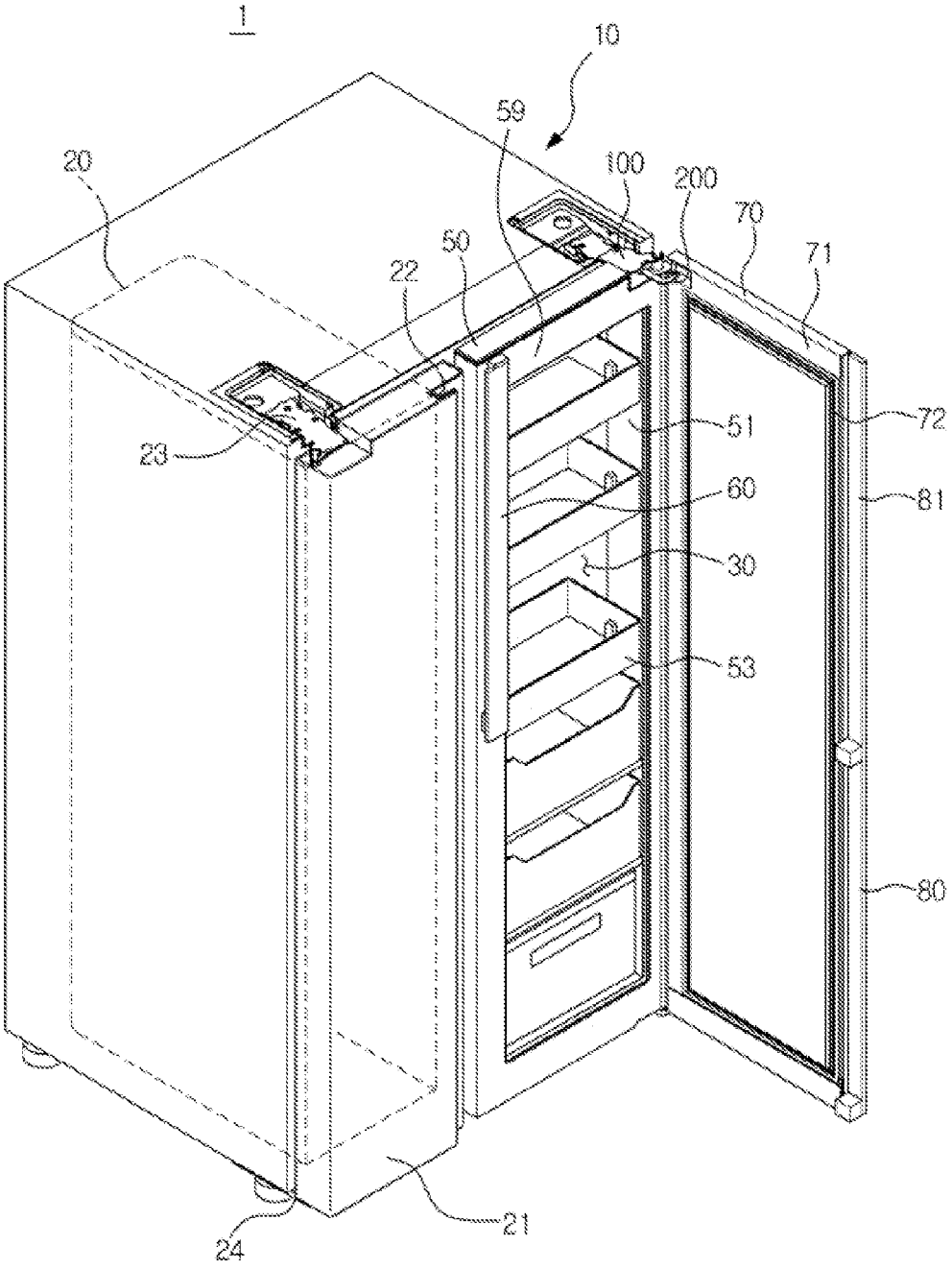
FIG. 2 is a perspective view illustrating the refrigerator of FIG. 1 in an opened state of the second door.
Figure 3:
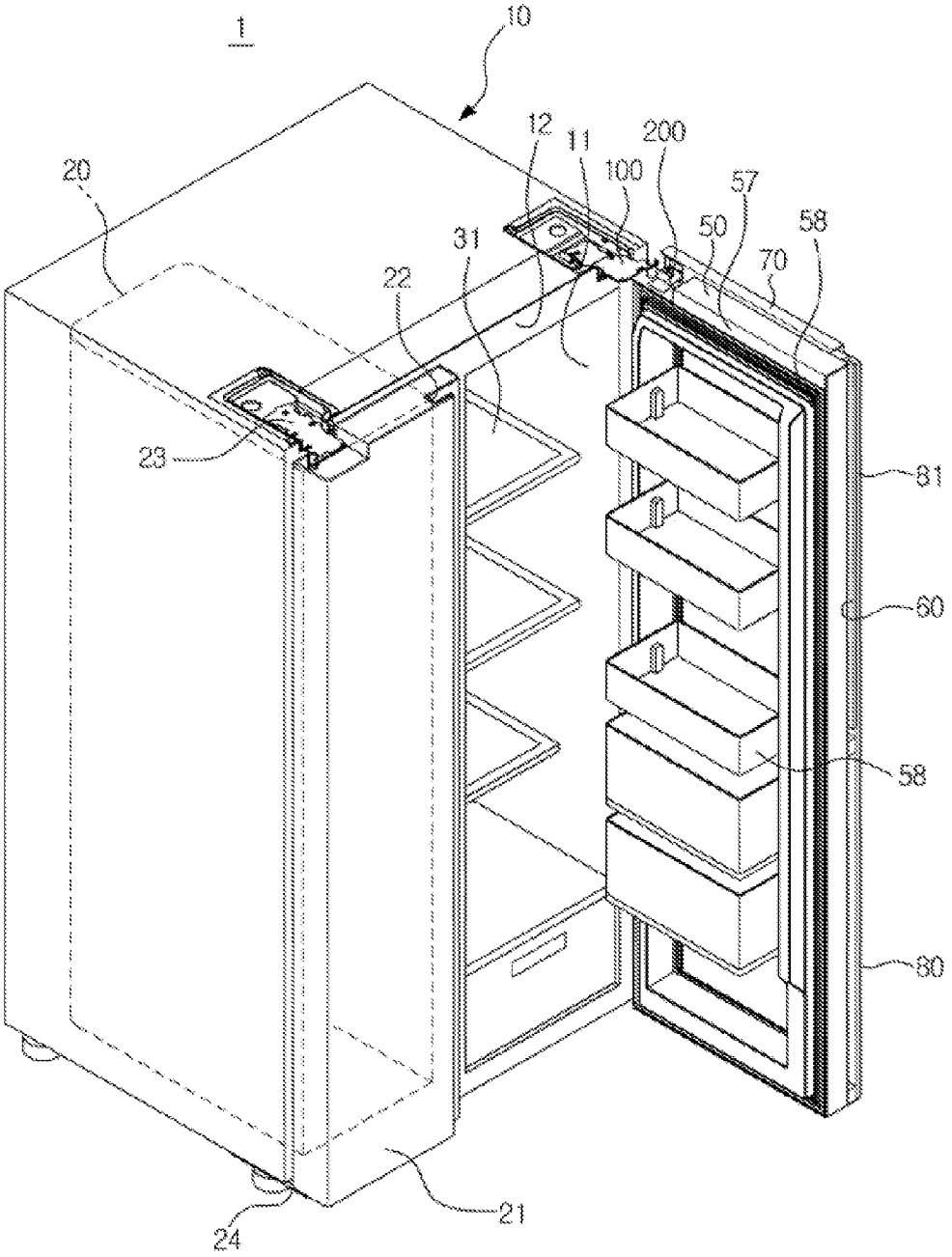
FIG. 3 is a perspective view illustrating the refrigerator of FIG. 1 in an opened state of the first door.
Figure 4:
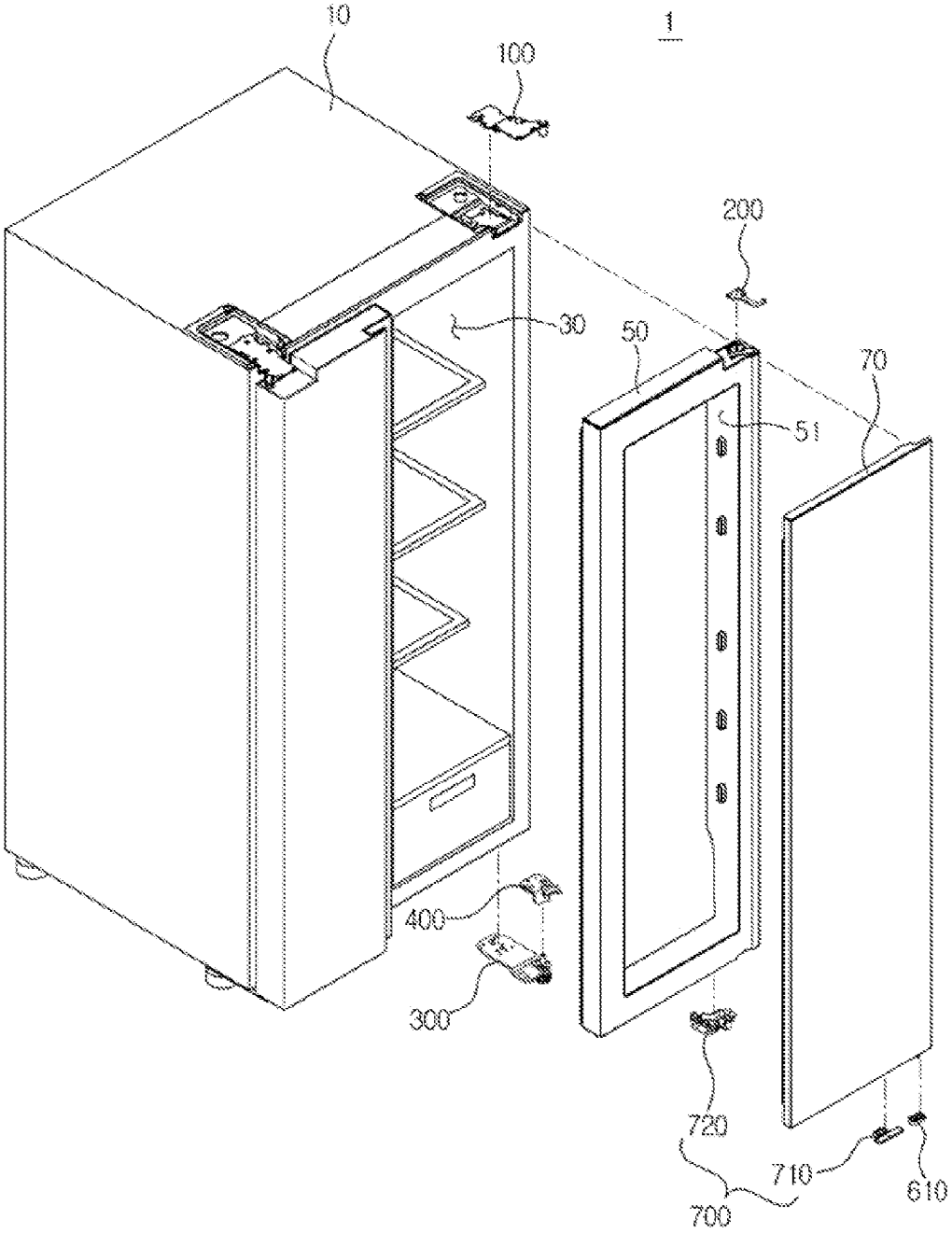
FIG. 4 is a perspective view illustrating the refrigerator of FIG. 1 in a separated state of the first and second doors.
Figure 14:
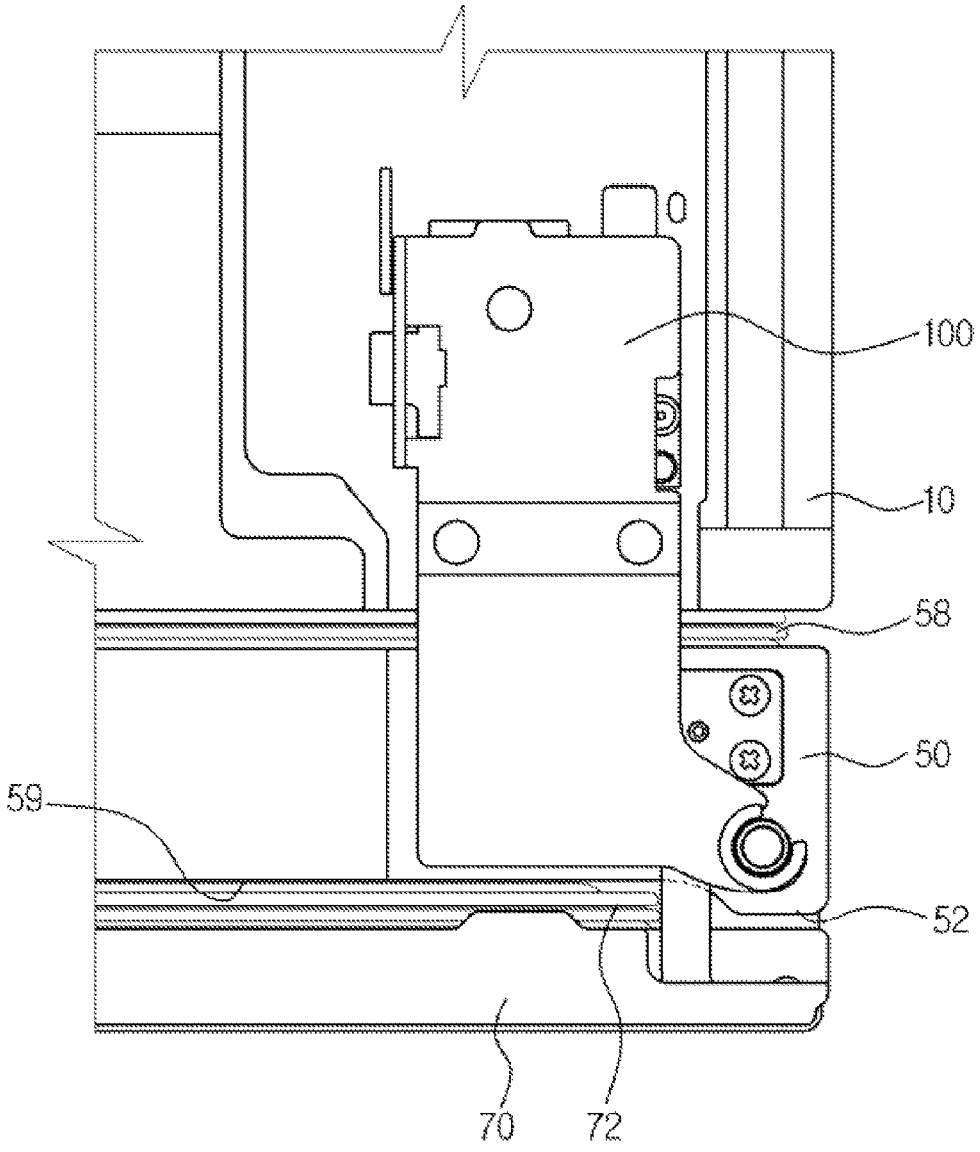
FIG. 14 is a plan view taken when the refrigerator of FIG. 1 is viewed from above.

FIG. 1 is a perspective view illustrating a refrigerator according to an embodiment in a state in which first and second doors are closed. FIG. 2 is a perspective view illustrating the refrigerator of FIG. 1 in an opened state of the second door. FIG. 3 is a perspective view illustrating the refrigerator of FIG. 1 in an opened state of the first door. FIG. 4 is a perspective view illustrating the refrigerator of FIG. 1 in a separated state of the first and second doors. FIG. 14 is a plan view taken when the refrigerator of FIG. 1 is viewed from above.

Referring to FIGS. 1 to 4, the refrigerator according to the illustrated embodiment of which is designated by reference numeral 1 includes a body 10, and a storage chambers 20 and 30 defined in an interior of the body 10. The refrigerator 1 further includes a cold air supplier to supply air to the storage chambers 20 and 30.

The body 10 is formed to have a substantially box shape. The body 10 includes an inner case 11 to define the storage chambers 20 and 30, an outer case 12 coupled to the inner case at an outside of the inner case, to define the appearance of the refrigerator 1, and an insulator disposed between the inner and outer cases 11 and 12. The inner case 11 may be made of a resin material, whereas the outer case 12 may be made of stainless steel.

The cold air supplier may include a compressor (not shown), a condenser (not shown), an expansion valve (not shown), and an evaporator (not shown). The cold air supplier may circulate a refrigerant, to produce cold air, using latent heat of evaporation of the refrigerant.

The storage chambers 20 and 30 may be divided into a left freezing compartment 20 and a right refrigerating compartment 30 by a vertical barrier wall (not shown). Of course, the positions of the freezing and refrigerating compartments 20 and 30 may be interchanged. Racks 31 may be provided at the refrigerating compartment 30, to accommodate food.

Each of the freezing and refrigerating compartments 20 and 30 has an opened front side, to allow food to be placed therein or retrieved therefrom. The opened front side of the freezing compartment 20 may be opened or closed by a freezing compartment door 21. The opened front side of the refrigerating compartment 20 may be opened or closed by a first door 50.

The freezing compartment door 21 is provided at the front side of the body 10, to be pivotable. The freezing compartment door 21 may be horizontally pivotable about a vertical hinge axis. The freezing compartment door 21 may be pivotably supported by an upper hinge 23 and a lower hinge 24 respectively coupled to upper and lower surfaces of the body 10.

Similarly, the first door 50 is provided at the front side of the body 10, to be pivotable. The first door 50 may be horizontally pivotable about a vertical hinge axis. The first door 50 may be pivotably supported by a first upper hinge 100 and a first lower hinge 300 respectively coupled to the upper and lower surfaces of the body 10.

A second door 70 is provided at the front side of the body 10 in front of the first door 50. The first door 50 may be pivotable in the same rotation direction as the first door 50. The hinge axes of the first and second doors 50 and 70 are parallel with each other, but are not coaxial. The second door 70 may be pivotably supported by a second upper hinge 200 and a second lower hinge 400 respectively coupled to upper and lower surfaces of the first door 50.

Configurations of the first upper hinge 100, first lower hinge 300, second upper hinge 200, and second lower hinge 400 will be described below.

The freezing compartment door 21 is provided with a handle 22 to allow the user to open or close the freezing compartment door 21 by grasping the handle 22.

Similarly, the first and second doors 50 and 70 are provided with first and second handles 60 and 80, respectively. The first and second handles 60 and 80 extend vertically while being substantially parallel with each other. The first handle 60 is disposed above the second handle 80. The first and second handles 60 and 80 form first and second grooves 91 and 92 to receive fingers of the user, respectively. Similarly to the first and second handles 60 and 80, the first and second grooves 91 and 92 extend vertically while being substantially parallel with each other. The first groove 91 is disposed above the second groove 92.

The user may grasp the first handle 60 by inserting his fingers into the first groove 91. Similarly, the user may grasp the second handle 80 by inserting his fingers into the second groove 92.

A cover 81 extends upward from the second handle 80, to cover the first handle 60. Accordingly, when the refrigerator is viewed from the front side, the first handle 60 may not be exposed because it is covered by the cover 81.

Meanwhile, the first door 50 is formed with an opening 51 having a slightly smaller size than the refrigerating compartment 30. At least one door pocket 53 to receive food may be provided at the opening 51. Food articles having a small size or low height or exhibiting high frequency of storage and retrieval may be stored in the door pocket 53. When two or more door pockets 53 are provided, they may be vertically aligned. Each door pocket 53 may be separably mounted to the door 51.

The second door 70 may have a substantially flat plate shape without having an opening. Accordingly, the second door 70 may open or close the opening 51 of the first door 50.

Hereinafter, operation of the first and second doors 50 and 70 having the above-described configurations according to the illustrated embodiment will be described. When the first and second doors 50 and 70 are closed, as illustrated in FIG. 1, the refrigerating compartment 30 is sealed and, as such, cold air in the refrigerating compartment 30 may be kept.

When the second door 70 is opened, as illustrated in FIG. 2, the user may access the door pockets 53, to store food in the door pockets 53 or to retrieve food from the door pockets 53. In this case, outflow of cold air from the refrigerating compartment 30 may be reduced, as compared to the case in which the first door 50 is in an opened state.

When the first door 50 is opened, as illustrated in FIG. 3, the user may access the interior of the refrigerating compartment 30, to place food on the racks 31 or to retrieve food from the racks 31. Of course, in this case, the user may access the door pockets 53, to store food in the door pockets 53 or to retrieve food from the door pockets 53.

Thus, the refrigerator 1 according to the illustrated embodiment of the present invention may achieve storage and retrieval of food in various manners as desired by the user while minimizing outflow of cold air.

Meanwhile, as illustrated in FIG. 3, a first gasket 58 is provided at a back surface 57 of the first door 50, to maintain a seal between the first door 50 and the outer case 12 of the body 10. In this case, the first gasket 58 may be made of a rubber material. The first gasket 58 includes a first magnet (not shown) to attract the outer case 12, which is made of stainless steel, so as to keep the first door 50 in a closed state.

Similarly, as illustrated in FIG. 2, a second gasket 72 is provided at a back surface 71 of the second door 70, to maintain a seal between the first door 50 and the second door 70. In this case, the second gasket 72 may be made of a rubber material. The second gasket 72 includes a second magnet (not shown) to attract a front surface 59 of the first door 50, which is made of stainless steel, so as to keep the second door 70 in a closed state.

Thus, in the refrigerator according to the illustrated embodiment, the first and second doors 50 and 70 are normally kept in a closed state by attractive force of the magnets. In particular, the force of the first magnet (not shown) of the first door 50 to attract the outer case 12 of the body 10 must be greater than the force of the second magnet (not shown) of the second door 70 to attract the first door 50, to prevent the first door 50 from being opened together with the second door 70 when the second door 70 is opened.

In this case, accordingly, when the user pulls the second door 70 by a greater force than the magnetic force of the second magnet (not shown) to attract the first door 50, the second door 70 may be opened under the condition that the first door 50 is in a closed state.

Meanwhile, the refrigerator according to the illustrated embodiment further includes a second door opening prevention device 700 to prevent the second door 70 from being unintentionally opened by inertial force generated when the first door 50 is opened.

When the user opens the first door 50 while grasping the first handle 60, pivotal movement of the first door 50 is stopped after the first door 50 is sufficiently opened. At this time, the second door 70 may be unintentionally opened, if the inertial force of rotation generated during the pivotal movement of the first door 50 is greater than the magnetic force of the second magnet (not shown) of the second door 70 to attract the first door (50).

This is because the pivotal movement directions of the first and second doors 50 and 70 are identical, and the second door 70 is connected to the first door 50 by the second upper hinge 200 and second lower hinge 400. The second door opening prevention device 700 may prevent the second door 70 from being unintentionally opened during opening of the first door 50. A detailed configuration of the second door opening prevention device 700 will be described below.

Meanwhile, as illustrated in FIG. 14, a gasket exposure prevention portion 52 is forwardly protruded from an edge of the first door 50. The gasket exposure prevention portion 52 prevents exposure of the second gasket 72 provided at the second door 70, thereby achieving an enhancement in aesthetics. In addition, it may be possible to prevent occurrence of accidents caused by jamming of fingers between the first and second doors 50 and 70.

Figure 5:
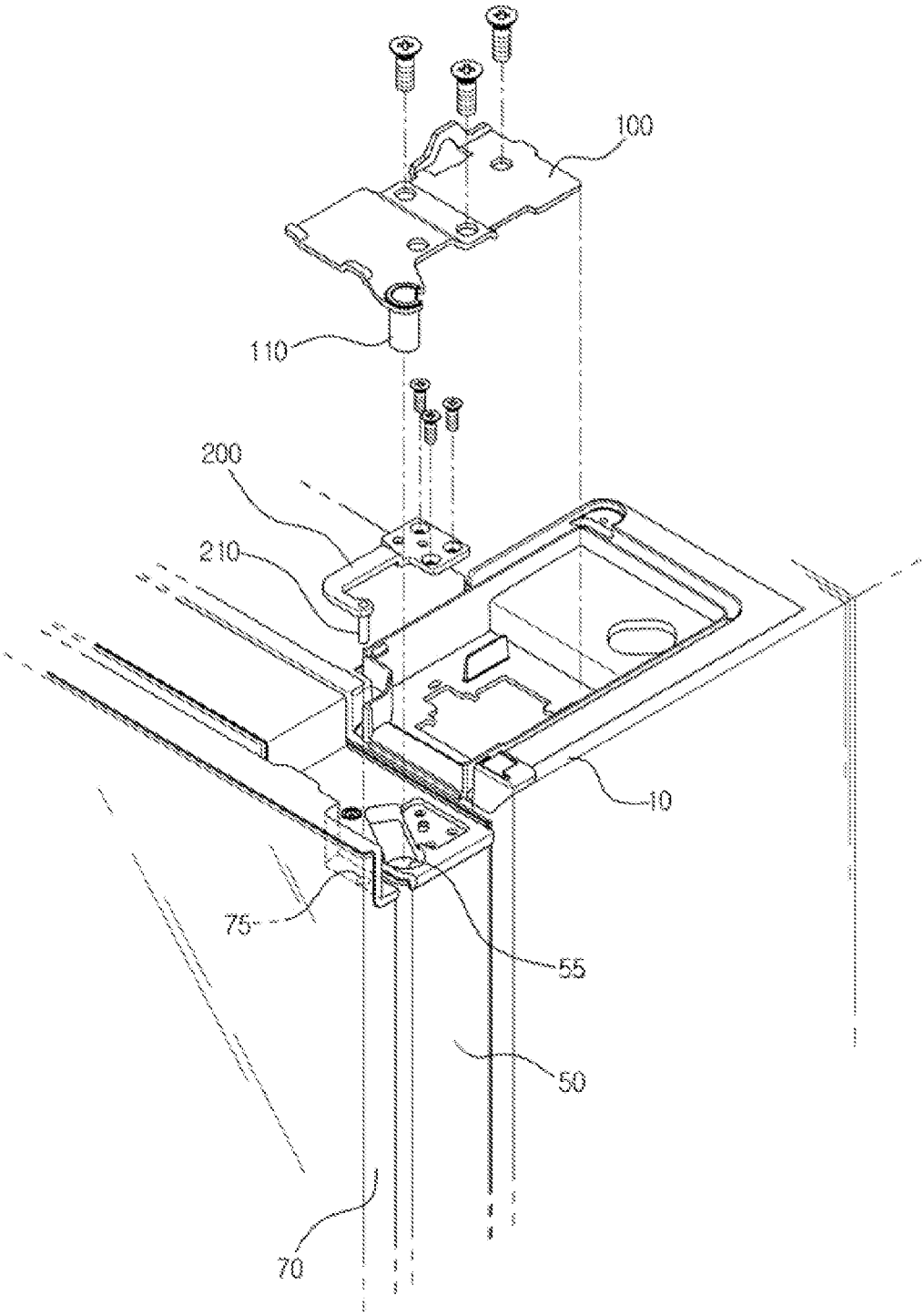
FIG. 5 is an exploded perspective view illustrating first and second upper hinges in the refrigerator of FIG. 1.
Figure 6:
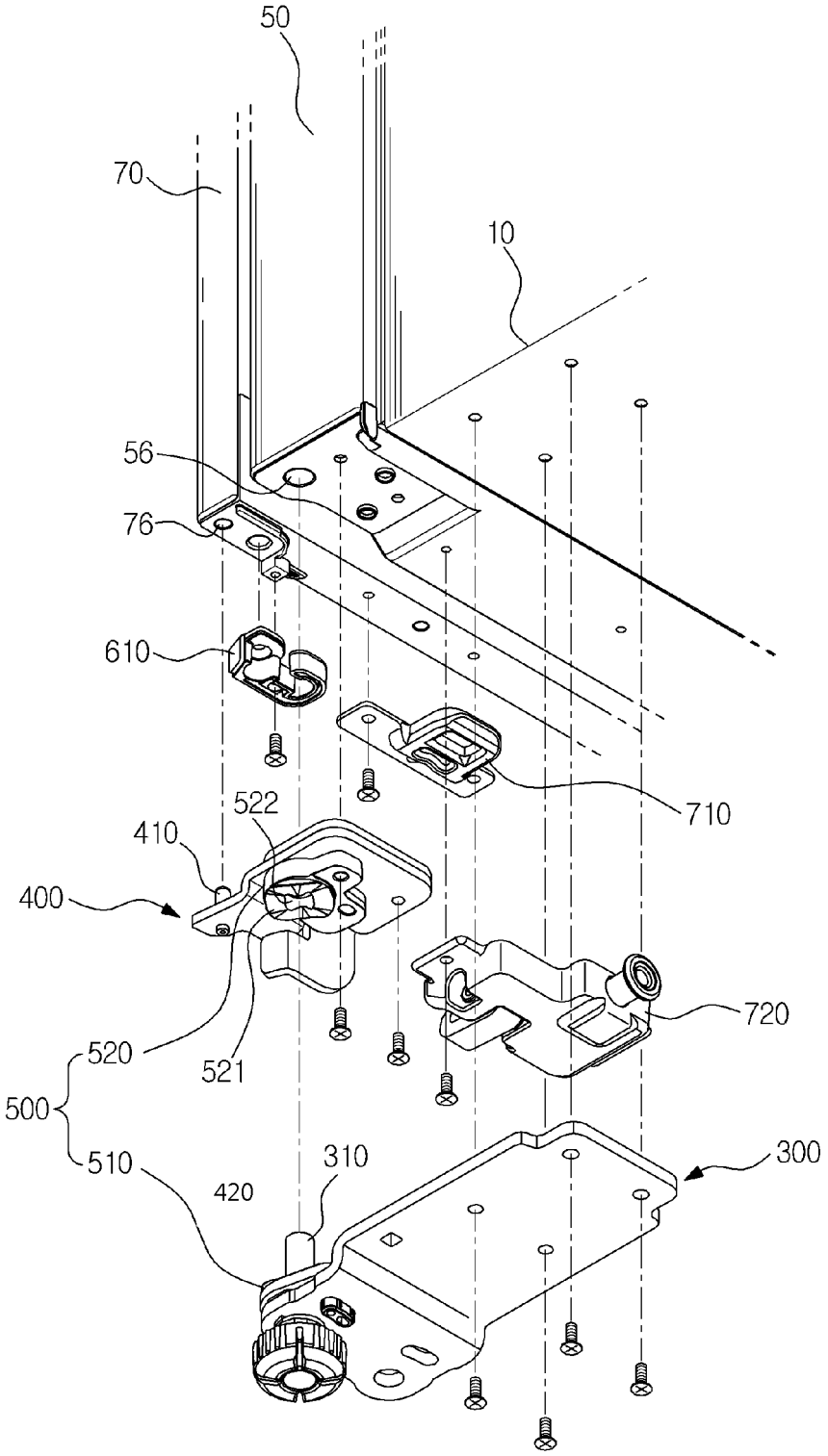
FIG. 6 is an exploded perspective view illustrating first and second lower hinges in the refrigerator of FIG. 1.
Figure 7:
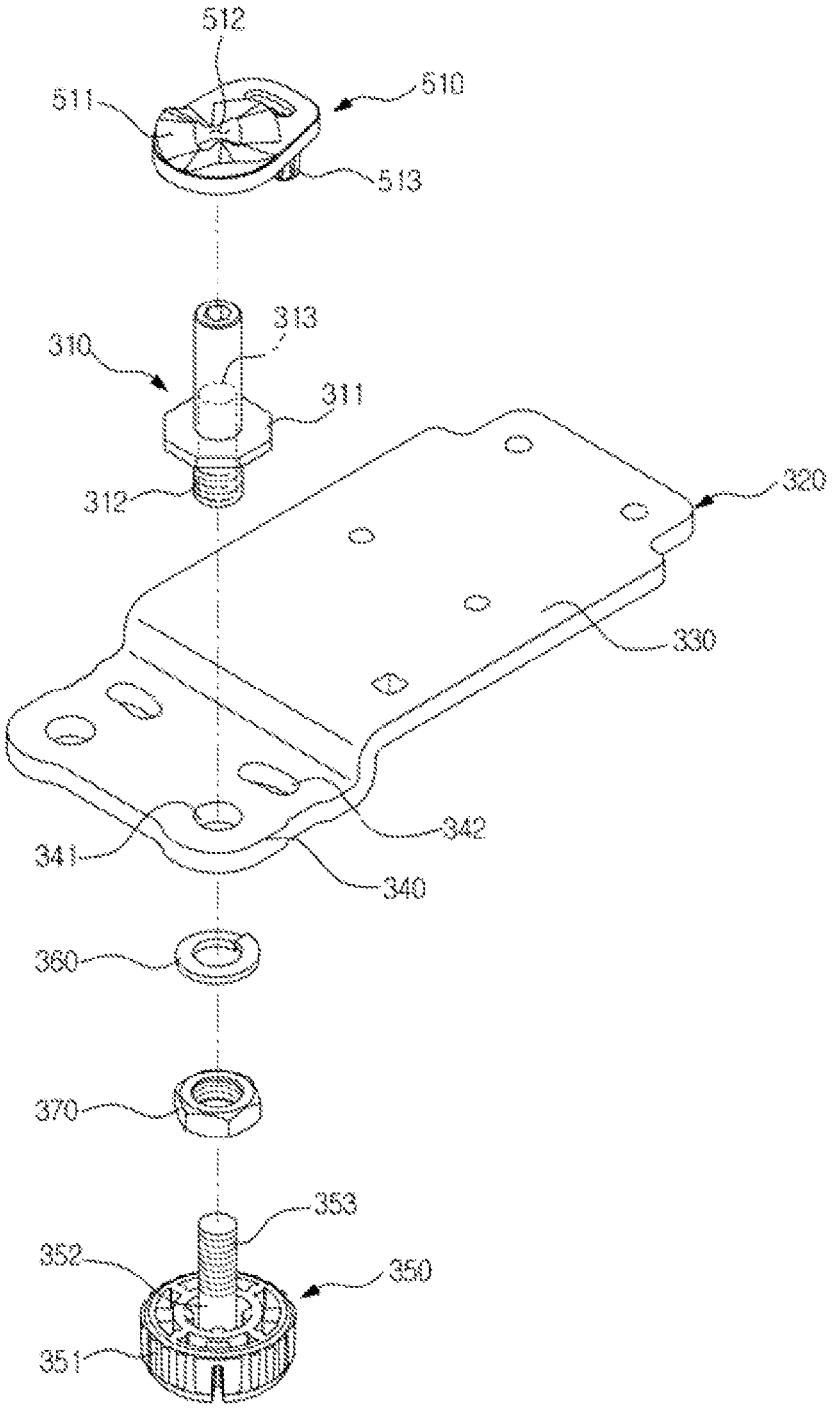
FIG. 7 is an exploded perspective view illustrating the first lower hinge in the refrigerator of FIG. 1.
Figure 8:
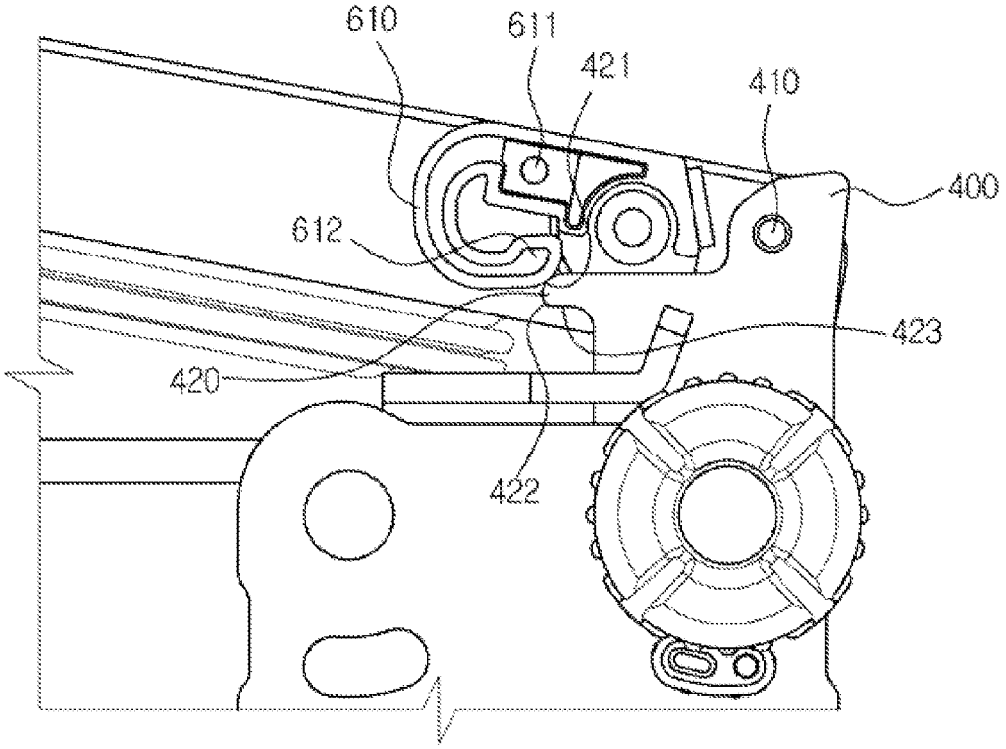
FIGS. 8 to 10 are views explaining operation of an auto closer included in the second door in the refrigerator of FIG. 1.
Figure 9:
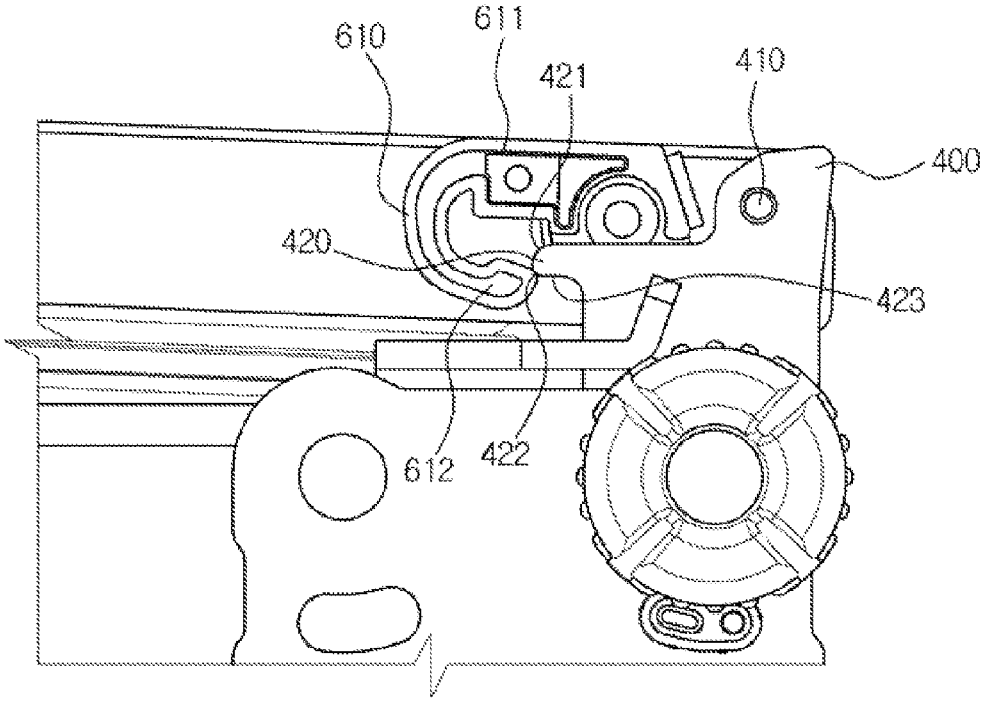
Figure 10:
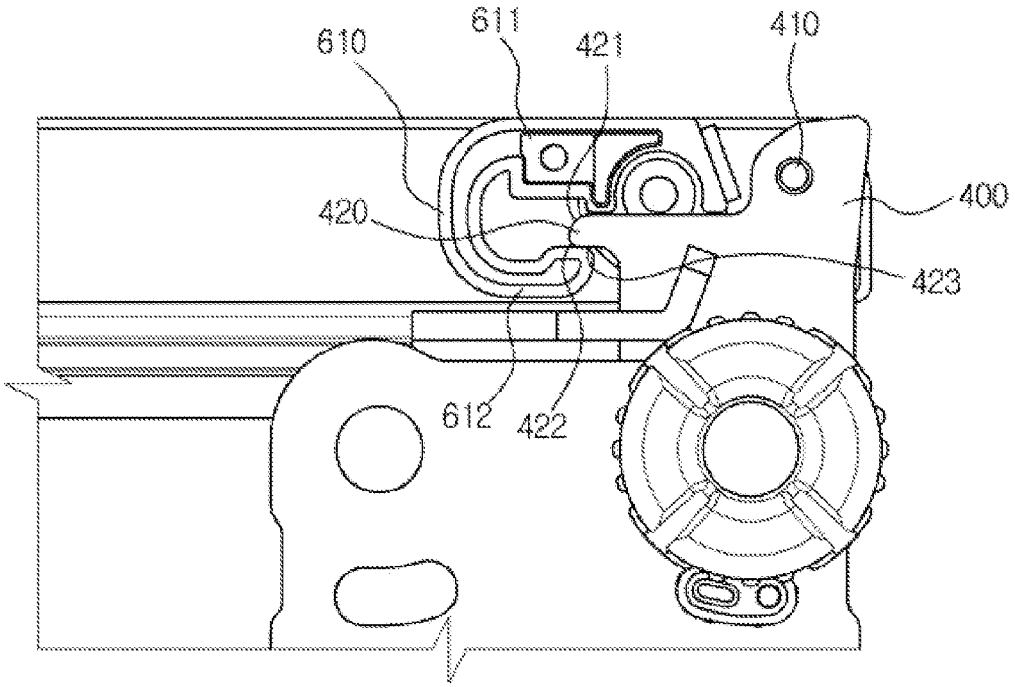

FIG. 5 is an exploded perspective view illustrating the first and second upper hinges in the refrigerator of FIG. 1. FIG. 6 is an exploded perspective view illustrating the first and second lower hinges in the refrigerator of FIG. 1. FIG. 7 is an exploded perspective view illustrating the first lower hinge in the refrigerator of FIG. 1. FIGS. 8 to 10 are views explaining operation of an auto closer included in the second door in the refrigerator of FIG. 1.

As illustrated in FIGS. 5 to 7, the first upper hinge 100, the first lower hinge 300, the second upper hinge 200, and the second lower hinge 400 are coupled to the upper surface of the body 10, the lower surface of the body 10, the upper surface of the first door 50, and the lower surface of the first door 50 by fastening members, respectively. Accordingly, through unfastening of the fastening members, separation of the first upper hinge 100, first lower hinge 300, second upper hinge 200, and second lower hinge 400 may be achieved.

The first upper hinge 100 includes a first upper hinge pin 110 to be inserted into an upper hinge hole 55 of the first door 50, so as to pivotably support the first door 50. The second upper hinge 200 includes a second upper hinge pin 210 to be inserted into an upper hinge hole 75 of the second door 70, so as to pivotably support the second door 70.

The first lower hinge 300 includes a first lower hinge pin 310 to be inserted into a lower hinge hole 56 of the first door 50, so as to pivotably support the first door 50. The second lower hinge 400 includes a second lower hinge pin 410 to be inserted into a lower hinge hole 76 of the second door 70, so as to pivotably support the second door 70.

Of course, the first upper hinge pin 110 and first lower hinge pin 310 extend coaxially, and the second upper hinge pin 210 and second lower hinge pin 410 extend coaxially. On the other hand, the axis of the first upper hinge pin 110 and first lower hinge pin 310 is different from the axis of the second upper hinge pin 210 and second lower hinge pin 410.

Meanwhile, the refrigerator according to the illustrated embodiment includes a first auto closer 500 to pivot the first door 50 in a closing direction to a position where the first door 50 is completely closed, when the first door 50 pivots a predetermined angle or more in the closing direction, and a second auto closer 600 to pivot the second door 70 in a closing direction to a position where the second door 70 is completely closed, when the second door 70 pivots a predetermined angle or more in the closing direction.

The first auto closer 500 may include a first cam member 510 having first cam surfaces 511 formed to be inclined in upward and downward directions in an alternating manner along a circumferential direction of the first cam member 510, and a second cam member 520 having second cam surfaces 521 formed to be inclined such that they correspond to the first cam surfaces 510.

The first cam member 510 may be coupled to an upper surface of the first lower hinge 300, whereas the second cam member 520 may be coupled to a lower surface of the second lower hinge 400. The first cam member 510 may include a through hole 512, through which the second lower hinge pin 310 extends, and a rotation prevention protrusion 513 to prevent the first cam member 510 from rotating together with the second lower hinge pin 310 during rotation of the second lower hinge pin 310. The second cam member 520 may include a through hole 522, through which the second lower hinge pin 310 extends.

In accordance with the above-described configuration, the first auto closer 500 may pivot the first door 50, through sliding operation of the second cam surfaces 521 along the first cam surfaces 511 by gravity.

Meanwhile, the second auto closer may include an elastic lever 610, which accumulates elastic force generated during closing of the second door 70, and pivots the second door 70 in the closing direction to the position where the second door 70 is completely closed, by the accumulated elastic force, when the second door 70 pivots the predetermined angle or more in the closing direction.

In this case, the elastic lever 610 may be coupled to the lower surface of the second door 70 and, as such, may be pressed by the second lower hinge 400 during closing of the second door 70, to be elastically deformed.

The elastic lever 610 may have a substantially U shape and, as such, may have a fixed end 611 and a movable end 612. The elastic lever 610 may be elastically deformed such that the gap between the fixed end 611 and the movable end 612 increases or decreases. The second lower hinge 400 may be formed with a pressing protrusion 420 protruded to press the elastic lever 610.

As illustrated in FIGS. 8 to 10, the pressing protrusion 420 may have a first surface 421, an inflection point 422, and a second surface 422 which are sequentially arranged in this order, namely, in an order of coming into contact with the movable end 612 of the elastic lever 610 during closing of the second door 70.

As illustrated in FIG. 9, the elastic lever 610 is maximally widened when the movable end 612 passes the inflection point 422. At this time, the elastic lever 610 accumulates a maximum elastic force. When the movable end 612 subsequently passes the second surface 422, the elastic lever 610 may pivot the second door 70 in a closing direction to a position where the second door 70 is completely closed, by the accumulated elastic force.

Meanwhile, the refrigerator according to the illustrated embodiment includes support legs. One of the support legs, namely, a support leg 350, has a support pin 352 arranged coaxially with the first lower hinge pin 310 in order to prevent the first lower hinge 300 from being bent in a downward direction due to weights of the first door 50 and food stored in the door pockets 53 of the first door 50.

In detail, as illustrated in FIG. 7, the first lower hinge 300 includes a hinge plate 320 having a fixing portion 330 to be coupled to the lower surface of the body 10 and an extension portion 340 extending downwardly of the first door 50. The first lower hinge 300 also includes the first lower hinge pin 310. The first lower hinge pin 310 is coupled to the extension portion 340 while being inserted into a lower end of the first door 50, to allow the first door 50 to pivot therearound. The first lower hinge shaft 310 is formed with a flange 311 extending radially, to receive the weight of the first door 50. The first lower hinge pin 310 may have an integrated structure.

The hinge plate 320 may be formed with a coupling hole 341, to which the first lower hinge pin 310 is coupled, and a rotation prevention bar coupling hole 342 to receive a rotation prevention bar 513 of the first cam member 510.

The first lower hinge pin 310 may extend through the coupling hole 341 of the hinge plate 320, to be vertically movable. A washer 360 and a nut 370 are coupled to the first lower hinge pin 310, to prevent the first lower hinge pin 310 from being separated from the coupling hole 341.

In addition, the first lower hinge 300 includes the support leg 350. The support leg 350 includes a support cap 351 to contact the floor, on which the refrigerator is placed, and a support pin 352 extending vertically from the support cap 351, to be axially coupled to the first lower hinge pin 310. The support pin 352 may be threadedly coupled to the first lower hinge pin 310 in an axial direction.

That is, female threads 313 may be formed at an inner peripheral surface of the first lower hinge pin 310, and male threads 353 may be formed at an outer peripheral surface of the support pin 352, to be threadedly coupled to the female threads 313 of the first lower hinge pin 310.

Thus, it may be possible to adjust the level of the first door 50 by varying the fastening amount of the support pin 352 to the first lower hinge pin 310. In addition, it may be possible to separate the support leg 350 from the first lower hinge pin 310, for replacement thereof.

The weight of the first door 50 applied to the first lower hinge pin 310 is directly transmitted to the floor via the support leg 350 coupled to the first lower hinge pin 310. Accordingly, it may be possible to prevent the hinge plate 320 from being bent in a downward direction.

Figure 11:
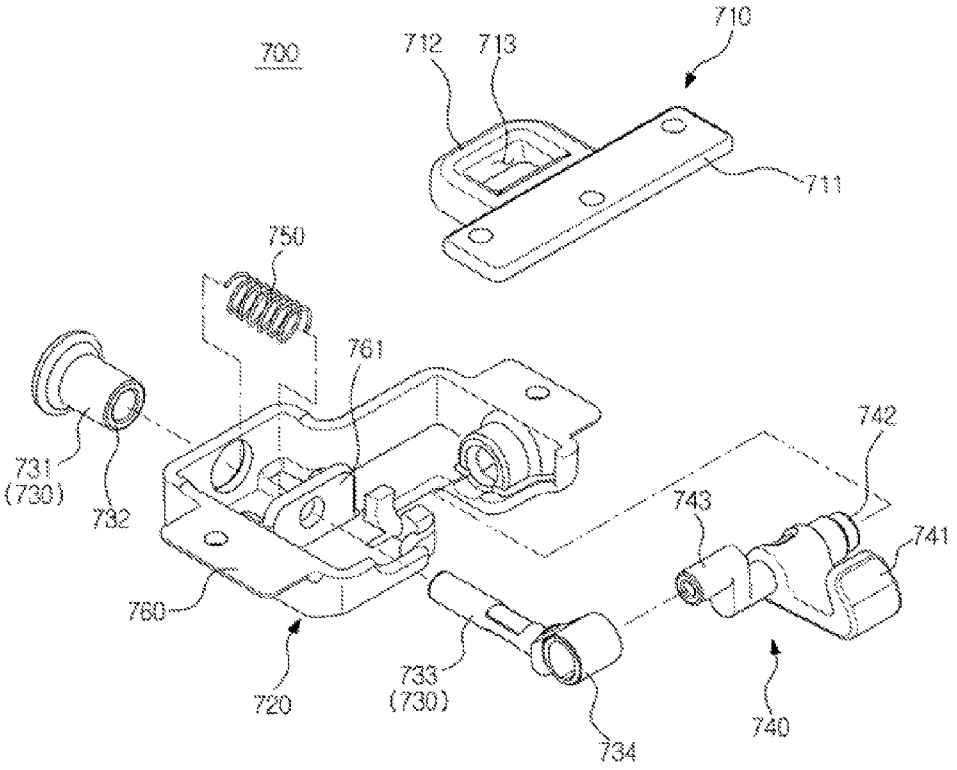
FIG. 11 is an exploded perspective view illustrating a second door opening prevention device in the refrigerator of FIG. 1.
Figure 12:
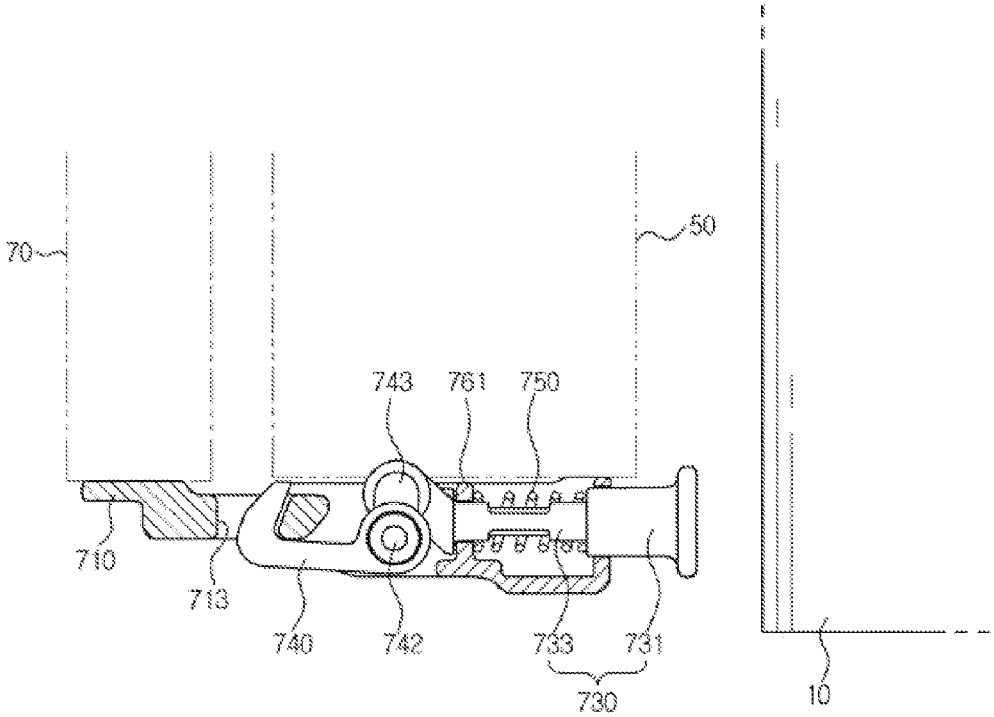
FIGS. 12 and 13 are views explaining operation of the second door opening prevention device in the refrigerator of FIG. 1.
Figure 13:
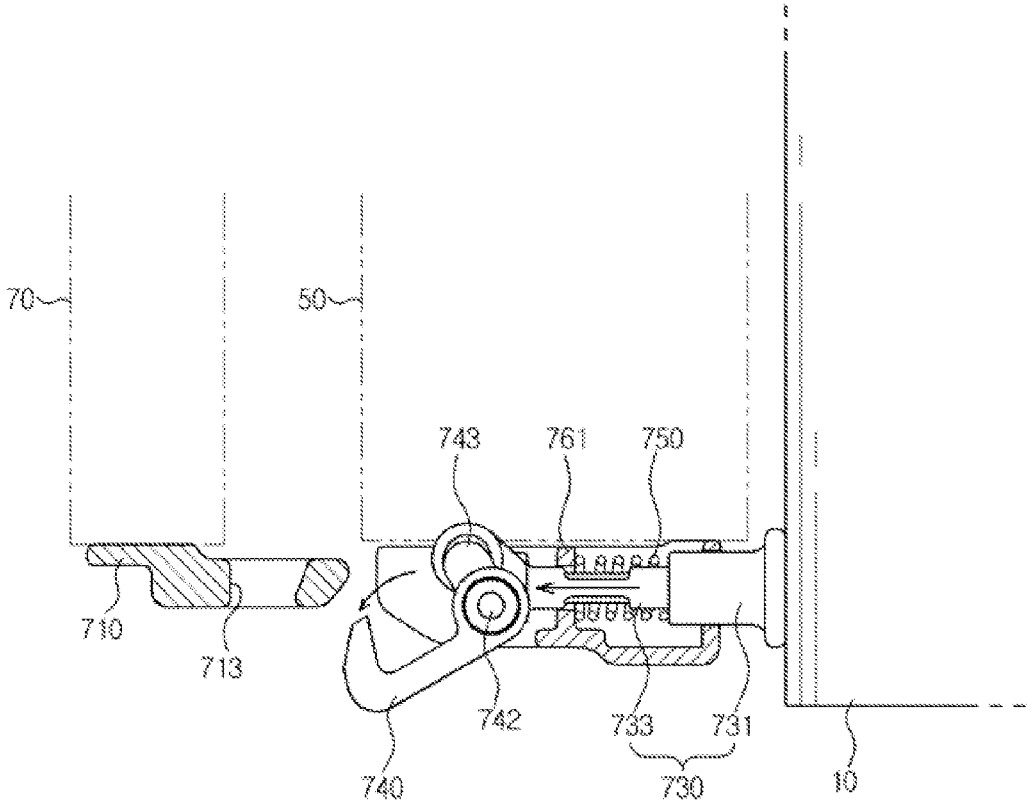

FIG. 11 is an exploded perspective view illustrating the second door opening prevention device in the refrigerator of FIG. 1. FIGS. 12 and 13 are views explaining operation of the second door opening prevention device in the refrigerator of FIG. 1.

As described above, the second door opening prevention device 700 may allow opening of the second door 70 in a closed state of the first door 50 while preventing opening of the second door 70 in an opened state of the first door 50.

As illustrated in FIGS. 11 to 13, the second door opening prevention device 700 includes a striker 710 coupled to the lower surface of the second door 70, and a latch 720 coupled to the lower surface of the first door 50, to be engaged with or disengaged from the striker 710 in accordance with opening or closing of the first door 50.

The latch 720 includes an actuation bar 730 to be pressed by the body 10 such that the actuation bar 730 is rectilinearly movable, and a rotation bar 740 to perform rotation in accordance with rectilinear movement of the actuation bar 730. The rotation bar 740 is formed, at one end thereof, with an engagement hook 741. The latch 720 also includes a return spring 750 to return the actuation bar 730 to an original position thereof when a pressing force from the body 10 to the actuation bar 730 is released.

The actuation bar 730 may include a head portion 731, to which the pressing force from the body 10 is directly applied, and a body portion 733 connected to the head portion 731. The head portion 731 may be formed with a support surface 732 to support the return spring 750.

The pivot bar 740 includes a rotation pin 742 as a rotation center, and a connecting pin 743 connected to the actuation bar 730, to receive drive force from the actuation bar 730. The connecting pin 743 is arranged to be eccentric from the rotation pin 742. A connecting hole 734 is formed at the actuation bar 730 and, as such, the connecting pin 743 of the rotation bar 740 may be rotatably inserted into the connecting hole 743.

The second door opening prevention device 700 may further include a housing 760 to receive the actuation bar 730, rotation bar 740, and return spring 750. The housing 760 may be coupled to the lower surface of the first door 50 by fastening members.

Meanwhile, the striker 710 includes a coupling plate 711 to be coupled to the lower surface of the second door 70, and an arm bar 712 formed with an engagement hole 713, into which the engagement hook 741 of the latch 720 may be inserted. The coupling plate 711 may be coupled to the lower surface of the second door 70 by fastening members. The striker 710 may be formed to have an integrated structure, using stainless steel.

As apparent from the above description, in accordance with an aspect, it may be possible to support double doors such that the double doors are smoothly rotatable.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a storage chamber;

a first door pivotably provided at a front side of the body, to open or close the storage chamber, the first door having an opening, and at least one door pocket provided at the opening;

a second door pivotably provided at a front side of the first door, to open or close the opening, the second door pivoting in a same direction as the first door and having a thickness thinner than a thickness of the first door;

a first upper hinge connecting the body and the first door and having a first upper hinge pin;

a second upper hinge connecting the first door and the second door and having a second upper hinge pin;

a first lower hinge connecting the body and the first door and having a first lower hinge pin; and a second lower hinge connecting the first door and the second door and having a second lower hinge pin; a second door opening prevention device to prevent the second door from opening when the first door is open, wherein the second lower hinge is configured to be supported by the first lower hinge such that a weight of the second door is supported by the body, wherein a support leg provided on the first lower hinge and while the support leg is supporting the refrigerator a support pin is disposed telescopically within the first lower hinge pin, wherein the refrigerator comprises a first auto closer configured to pivot the first door in a closing direction to a position where the first door is completely closed, when the first door is closed a predetermined angle or more in the closing direction, wherein the first auto closer comprises a first cam member coupled to an upper surface of the first lower hinge while allowing the first lower hinge pin to penetrate the upper surface of the first lower hinge and a second cam member coupled to a lower surface of the second lower hinge while allowing the first lower hinge pin to penetrate the lower surface of the second lower hinge, wherein the first cam member comprises a rotation prevention bar to prevent the first cam member from pivoting together with the first lower hinge pin when the first lower hinge pin pivots, and the first lower hinge comprises a rotation prevention bar coupling hole in which the rotation prevention bar is accommodated, and wherein the second door opening prevention device comprises a latch to hold the second door closed when the first door is in an open position and the latch is rotated to a released position when the first door is in a closed position based on an actuation bar that is rectilinearly movable being in one of a compressed state while in contact with the body of the refrigerator and a non-compressed state while not in contact with the body of the refrigerator.

2. The refrigerator according to claim 1, wherein the first upper hinge, the first lower hinge, the second upper hinge, and the second lower hinge are coupled to an upper surface of the body, a lower surface of the body, an upper surface of the first door, and a lower surface of the first door by fastening members, respectively, and are separable through unfastening of the fastening members.

3. The refrigerator according to claim 1, wherein pivotal axes of the first door and second door are not coaxial.

4. The refrigerator according to claim 1, wherein the first auto closer comprises a first cam member having first cam surfaces formed to be inclined in upward and downward directions in an alternating manner along a circumferential direction of the first cam member, and a second cam member having second cam surfaces formed to be inclined such that the second cam surfaces correspond to the first cam surfaces.

5. The refrigerator according to claim 1, further comprising:

a second auto closer to pivot the second door in a closing direction to a position where the second door is completely closed, when the second door pivots a predetermined angle or more in the closing direction.

6. The refrigerator according to claim 5, wherein the second auto closer comprises an elastic lever to accumulate an elastic force generated during closing of the second door, and then to pivot the second door in the closing direction to the position where the second door is completely closed, by the accumulated elastic force, when the second door pivots the predetermined angle or more in the closing direction.

7. The refrigerator according to claim 5, wherein the second auto closer comprises an elastic lever coupled to a lower surface of the second door, the elastic lever being pressed by the second lower hinge during closing of the second door, to be elastically deformed.

8. A refrigerator comprising:

a body having a storage chamber;

a first door pivotably provided at a front side of the body, to open or close the storage chamber, the first door having an opening, and at least one door pocket provided at the opening;

a second door pivotably provided at a front side of the first door, to open or close the opening, the second door pivoting in a same direction as the first door;

a first upper hinge and a first lower hinge to pivotably support the first door;

a second upper hinge and a second lower hinge to pivotably support the second a second door opening prevention device to prevent the second door from opening when the first door is open, wherein the second lower hinge is configured to be supported by the first lower hinge such that a weight of the second door is supported by the body, wherein a support leg provided on the first lower hinge and while the support leg is supporting the refrigerator a support pin is disposed telescopically within a first lower hinge pin, wherein the refrigerator comprises a first auto closer configured to pivot the first door in a closing direction to a position where the first door is completely closed, when the first door is closed a predetermined angle or more in the closing direction, wherein the first auto closer comprises a first cam member coupled to an upper surface of the first lower hinge while allowing the first lower hinge pin to penetrate the upper surface of the first lower hinge and a second cam member coupled to a lower surface of the second lower hinge while allowing the first lower hinge pin to penetrate the lower surface of the second lower hinge, wherein the first cam member comprises a rotation prevention bar to prevent the first cam member from pivoting together with the first lower hinge pin when the first lower hinge pin pivots, and the first lower hinge comprises a rotation prevention bar coupling hole in which the rotation prevention bar is accommodated, and wherein the second door opening prevention device comprises a latch to hold the second door closed when the first door is in an open position and the latch is rotated to a released position when the first door is in a closed position based on an actuation bar that is rectilinearly movable being in one of a compressed state while in contact with the body of the refrigerator and a non-compressed state while not in contact with the body of the refrigerator.

9. The refrigerator according to claim 8, further comprising a second door opening prevention device to prevent the second door from opening when the first door is open.

10. The refrigerator according to claim 9, wherein the second door opening prevention device comprises a latch to hold the second door closed when the first door is in an open position and the latch is rotated to a released position when the first door is in a closed position.

11. A refrigerator comprising:

a body having a storage chamber;

a first door pivotably provided at a front side of the body, to open or close the storage chamber, the first door having an opening, and at least one door pocket provided at the opening;

a second door pivotably provided at a front side of the first door, to open or close the opening, the second door pivoting in a same direction as the first door;

a first lower hinge coupled to the lower surface of the body and extending into the first door to support the first door;

a second lower hinge coupled to the lower surface of the first door and extending into the second door to support the second door; a second door opening prevention device to prevent the second door from opening when the first door is open, wherein the first lower hinge comprises a first lower hinge pin configured to penetrate the second hinge and be inserted into a lower part of the first door, wherein the second lower hinge is configured to be supported by the first lower hinge such that a weight of the second door is supported by the body, wherein a support leg provided on the first lower hinge and while the support leg is supporting the refrigerator a support pin is disposed telescopically within the first lower hinge pin, wherein the refrigerator comprises a first auto closer configured to pivot the first door in a closing direction to a position where the first door is completely closed, when the first door is closed a predetermined angle or more in the closing direction, wherein the first auto closer comprises a first cam member coupled to an upper surface of the first lower hinge while allowing the first lower hinge pin to penetrate the upper surface of the first lower hinge and a second cam member coupled to a lower surface of the second lower hinge while allowing the first lower hinge pin to penetrate the lower surface of the second lower hinge, wherein the first cam member comprises a rotation prevention bar to prevent the first cam member from pivoting together with the first lower hinge pin when the first lower hinge pin pivots, and the first lower hinge comprises a rotation prevention bar coupling hole in which the rotation prevention bar is accommodated, and wherein the second door opening prevention device comprises a latch to hold the second door closed when the first door is in an open position and the latch is rotated to a released position when the first door is in a closed position based on an actuation bar that is rectilinearly movable being in one of a compressed state while in contact with the body of the refrigerator and a non-compressed state while not in contact with the body of the refrigerator.

12. The refrigerator according to claim 11, wherein the first cam member and the second cam member are located between the first lower hinge and the second lower hinge.

13. The refrigerator according to claim 12, wherein the first lower pin is configured to penetrate the first cam member and the second cam member.

* * * * *